US006383248B1

(12) United States Patent
Taylor et al.

(10) Patent No.: US 6,383,248 B1
(45) Date of Patent: May 7, 2002

(54) PROCESS FOR MANUFACTURING PRECIOUS METAL ARTIFACTS

(75) Inventors: Terence Ernest Taylor, Surbiton; Stephen Paul Hurford, Chessington, both of (GB)

(73) Assignee: Engelhard-CLAL UK Ltd. (GB)

( * ) Notice: Subject to any disclaimer, the term of this patent is extended or adjusted under 35 U.S.C. 154(b) by 0 days.

(21) Appl. No.: 09/486,270

(22) PCT Filed: Sep. 10, 1998

(86) PCT No.: PCT/GB98/02733

§ 371 Date: Mar. 23, 2000

§ 102(e) Date: Mar. 23, 2000

(87) PCT Pub. No.: WO99/14387

PCT Pub. Date: Mar. 25, 1999

(30) Foreign Application Priority Data

Sep. 12, 1997 (EP) ..... 97307093

(51) Int. Cl.[7] ..... B22F 3/12; B22F 3/24

(52) U.S. Cl. ..... 75/247; 419/28; 419/29; 419/38

(58) Field of Search ..... 419/28, 29, 38; 75/247, 331, 355

(56) References Cited

U.S. PATENT DOCUMENTS

| | | | | |
|---|---|---|---|---|
| 2,188,873 A | * | 1/1940 | Comstock | |
| 3,606,766 A | * | 9/1971 | Hill | |
| 4,002,503 A | * | 1/1977 | Bourne et al. | |
| 4,401,609 A | | 8/1983 | McGarry et al. | |
| 4,479,823 A | | 10/1984 | Hohmann | |
| 4,664,855 A | * | 5/1987 | Tremblay et al. | 264/11 |
| 4,933,023 A | * | 6/1990 | Wahlbeck | 148/3 |
| 5,000,779 A | * | 3/1991 | German et al. | 75/244 |
| 5,376,328 A | * | 12/1994 | Hoshino et al. | 419/36 |

FOREIGN PATENT DOCUMENTS

| | | |
|---|---|---|
| DE | 33 36 526 C1 | 2/1985 |
| JP | 64-65203 | 3/1989 |

OTHER PUBLICATIONS

Beynon, Aggie, K., "Powder Metallurgy", *Metalsmith* (Fall, 1982).

Strauss, J.T., "Powder Metallurgy (P/M) Applications in Jewelry Manufacturing", The Santa Fe Symposium on Jewelry Manufacturing Technology 1997, edited by D. Schneller, p. 105 ff.

Taylor, S.S., "Decorative Precious Metal Composites Give a New Dimension to Jewelry Design" Proceedings of the Stanta Fe Symposium on Jewelry Manufacturing Technology 1997, edited by D. Schneller, p. 443 ff.

Strauss, J.T., "P/M Powder Metallurgy and Potential Applications in Jewelry Manufacturing", Proceedings of the Santa Fe Symposium on Jewelry Technology 1998, p. 339 ff.

* cited by examiner

*Primary Examiner*—Ngoclan Mai
(74) *Attorney, Agent, or Firm*—Welsh & Katz, Ltd.

(57) ABSTRACT

A wedding ring is manufactured by a process comprising the production of a metal powder by the atomizing of a stream of molten precious metal, for example a gold alloy, the compaction of the metal powder into a hollow cylindrical body, the sintering of the compacted body, optionally the compression of the sintered body into a more toroidal shape, optionally the sintering of the toroidal body and the subjecting of the body to ring-rolling and annealing. The powder that is compacted any also comprise a minor proportion of precious-metal powder obtained by means other than atomization. The process may also be applied to the manufacture of artifacts other than rings by compacting the powder into an appropriate shape and modifying the compressing step, if employed, as appropriate to the intended product; in such embodiments, the ring-rolling step may be replaced by an appropriate step of further modifying the shape and/or dimension of the body. or may be omitted entirely.

27 Claims, No Drawings

PROCESS FOR MANUFACTURING PRECIOUS METAL ARTIFACTS

FIELD OF THE INVENTION

The present invention relates to a process for the manufacture of precious metal artifacts, especially items of jewelry such as rings. The invention also relates to precious metal artefacts whenever manufactured by that process.

BACKGROUND TO THE INVENTION

A process currently in commercial use for the manufacture of wedding rings, which was developed by Karl Klink, comprises the following operations. Initially, long ingots of gold are produced in a continuous casting process, which ingots are then subdivided into slabs, typically about 20 kg in weight and about 1 inch (25.4 mm) in thickness. The surfaces of the slabs are machined in order to remove the roughness left by the casting process, after which the slabs are annealed, that is to say subjected to a heat treatment in order to homogenise the metal, following which the slabs are subjected to a rolling process in order to produce a thinner sheet. In practice, the slabs are subjected to a number of alternating rolling and annealing steps, typically five annealing steps with four rolling steps interspersed between them. When the desired thickness has been achieved, typically about 0.1 inch (2.5 mm), washers are stamped out of the sheet by means of a suitable press. The washers are then further annealed and then formed into hollow cones which, following a further annealing step, are subjected to a drawing operation to convert them into cylinders. Following a further annealing step, the cylinders are "repressed", that is to say squashed to approximately the height of the intended rings. After yet another annealing step, the repressed cylinders are subjected to "ring rolling", that is to say they are passed between rollers in order to produce semi-finished wedding rings, which are then ready for final finishing operations, such as polishing, diamond cutting and/or engraving.

The foregoing process suffers from a number of disadvantages. In particular, the numerous operations that are required result in a process that is lengthy and costly. In addition, a very considerable quantity of scrap is generated, especially during machining, trimming and the stamping-out of washers: as a result, the yield of finished product, namely the formed wedding rings, is low, typically at about 30% of the original melt weight.

U.S. Pat. No. 4,479,823 (Hohmann, assigned to Blendax-Werke R. Schneider GmbH & Co.), which corresponds to DE-C-3,240,256, discloses a process for the production of a master alloy powder useful for amalgamation with mercury to form a dental filling material, which process comprises atomising an alloy containing silver, tin and copper into a spherical powder, the pulverisation being carried out for example, by inert-gas pulverisation or by a high-pressure-water method. The resultant powder is dried and formed into a coherent shaped article: thus, square blocks may be formed by mechanical pressing or round rods may be formed isostatically. The shaped article is then sintered at an elevated temperature, in particular in the recrystallisation temperature range of 150–350° C. for about half-an-hour under a reducing atmosphere. The sintered article is then pulverised by machining, e.g. in a milling or turning operation, to form the master alloy powder.

DE-C-3,336,526 (Degussa A G) discloses sintered blanks for stampings made of various precious metals (in particular gold, silver, palladium, platinum and their alloys) for the manufacture of jewellery and such articles as coins, medals and plates, which blanks exhibit a porosity of 8 to 35% by volume. The blanks are said to exhibit excellent stampability, in that they may be fully minted after one or two stamping cycles. Thus, Example 6 of this German patent discloses a mixture of 95% by weight of a gold alloy powder and 5% by weight of glass powder produced by atomising, which mixture was pressed into a mould under a pressure of 2 kbar in order to produce a die piece having about 70% of the theoretical density. After one hour's sintering at 800° C., the porosity was about 20% by volume. The resultant circular blanks could be fully minted in a die-set in two cycles (compared with conventional blanks of the same carat value, for which at least 5–8 cycles would be necessary).

Japanese laid-open (Kokai) patent publication No. 64–65203 (Tokuriki Honten Co. Ltd.) discloses a silver/metal oxide rod useful in medium-load electrical contacts. Such a rod is produced by welding, under pressure and at a temperature of 600° C. or higher, a sheath of silver onto the outer surface of a silver/metal oxide material which contains from 5 to 30% by weight of oxide dispersed in the silver. The resultant composite is worked to a prescribed diameter, bringing the thickness of the silver sheath to between 0.02 mm and 0.3 mm. The oxides include the oxides of cadmium, tin, antimony, zinc or indium. In a working example, silver, cadmium and antimony were fused together and then pulverised by water atomisation. The powder was subjected to internal oxidation at 700° C. and the material, described as "moulded and sintered", was then plugged into a tube made from silver and lids also made of silver were then welded on. The composite billet was heated to 850° C. and hot-extruded to form a rod with a diameter of 10 mm, after which a composite rod with a diameter of 3 mm was obtained by repeated annealing and drawing. In another working example, the silver tube and lids were replaced with a tube and lids made of silver to which 0.1% by weight of nickel had been added.

Aggie Bevnon, "Powder Metallurgy", *Metalsmith* (Fall 1982) describes the production of artefacts made of heterogeneous mixtures of metals. The process comprised the charging to a die cavity of various powdered metals in layers, followed by tamping-down to eliminate air pockets and then compression under pressure to consolidate the powders in a green compact strong enough to be handled. Pressures of $30–40\times10^3$ psi (206.8 to 275.8 MPa) appear to have been preferred. The green compact was then sintered in a reducing atmosphere, the furnace being set at either 732° C. for a silver-monel mixture or 816° C. for a copper-monel mixture. Depending upon the intended design of the artefacts, the sintered compact was milled, rolled or cut. The article suggests that several experiments employing 14 carat milled gold and atomised 8 carat gold powder were carried out but indicates that the gold powders have been barely satisfactory: the milled gold particles were too large, in comparison to the other materials, which resulted in much shrinking during sintering, whereas in the case of the commercial atomised gold, the powder refused to bond, except when locked in place by the adjacent metal.

SUMMARY OF THE INVENTION

In one aspect of the present invention, there is provided a process for the manufacture of an artefact from a precious metal, which process comprises compacting a precious-metal powder into a shaped body, wherein at least 80% by weight of the powder has been produced by water atomization of a stream of molten precious metal; sintering the said body; and thereafter annealing the said body.

As discussed hereinafter, the term "annealing" is to be construed broadly to include not only full annealing but also partial annealing or any heating step in which stress induced in the body by any preceding step is at least partially relieved.

The expression "precious metal" herein applies not only to an elemental precious metal, such as gold, silver or platinum, in pure or substantially pure form, but also to an alloy that has a substantial content, e.g. at least 30% by weight, of an elemental precious metal or of a mixture of elemental precious metals.

In another aspect of the present invention, there is provided an artefact manufactured by a process according to the first aspect of the invention.

DESCRIPTION OF EXEMPLARY EMBODIMENTS

In certain preferred embodiments the process comprises, between the steps of sintering the body obtained by compaction and the annealing of the body, the further step of modifying the shape and/or dimensions of the body. In such embodiments as are directed to the production of a ring, e.g. a wedding ring or band, this modification step may comprise or consist in a ring-rolling step.

In certain of the aforesaid embodiments, the process comprises, between the sintering step and the modification step, an additional step of adjusting the shape and/or dimensions of the compacted, sintered body. The adjustment of the shape and/or dimensions of the body may be carried out by repressing the sintered, compacted body, as by further compacting, compressing or squashing it. Typically, this adjustment step is carried out in order to adjust the height of the compact. Where the process is directed to the manufacture of a ring, the sintered compacted body may be in the shape of a hollow cylinder which is then repressed into a body of substantially toroidal shape.

In certain embodiments, especially when the sintering of the compacted body has been carried out for a comparatively short period, it may be appropriate to subject the body to a further sintering step, in particular before the step of modifying the shape and/or dimensions of the body (e.g. a ring-rolling step) and, in general, after the additional step of adjusting the shape and/or dimensions of the body (e.g. a re-pressing step).

In certain embodiments the present invention provides a process which comprises, between the said steps of sintering the body obtained by compaction and the annealing of the body, the further step of adjusting the shape and/or dimensions of the body and thereafter subjecting it to further sintering, and which optionally further comprises, between the said further sintering and the annealing step, the further step of modifying the shape and/or the dimensions of the body.

It is particularly preferred that the metal in the artefact manufactured by the present process should be homogeneous or substantially so. Thus, it is desirable that regions (e.g. layers or domains) of different metallic constitution should not be visible to the naked eye. Heterogeneity tends to reduce the strength and cohesion of the artefact.

It is further preferred that the metal in the artefact should be free of oxidation or at least substantially so. It is preferred that the oxide content (measured as oxygen) in the metal be no more than 1.0% by weight of the metal, and especially no more than 0.1% by weight, for example no more than 0.01% by weight.

In an initial stage of a process for preparing wedding rings from 9 carat gold alloy, weighed amounts of gold, silver, copper and zinc, in ratios appropriate for the production of the intended 9 carat alloy, are put into a melting pot or crucible. The form in which the metals are added to the pot or crucible, for example scrap, grain or powder, is not considered critical. The metals are then melted together; mixing may be effected by conventional means, for instance by mechanical or induction stirring. The liquid alloy is thereafter poured into a tundish, having a bottom surface which is provided with one or more nozzles. The or each nozzle will preferably have a hole diameter of from 1.5 mm to 7 mm. The molten alloy flows through the or each nozzle, emerging as a falling liquid stream from it. The most suitable metal pour temperature will, of course, vary according to the constitution of the metal: the pour temperature will be generally from (1.1×liquidus) to (1.5×liquidus), preferably from (1.2×liquidus) to (1.3×liquidus). The tundish temperature will generally be in the range from (0.5×liquidus) to (1.3×liquidus), preferably up to (1.1×liquidus), for example up to (1.0×liquidus). Unless otherwise stated, in this specification the liquidus (by which is meant the temperature at which a metal or alloy when heated becomes completely melted) is expressed in degrees Celsius.

The falling liquid stream of molten metal is subjected to the action of one or more high-pressure jets of water and is thereby atomized and cooled to form a powder. The production of metal powders by atomization is a well-known technique in metallurgy (see, for example, Andrew J. Yule and John J. Dunkley, *Atomisation of Melts for Powder Production and Spray Deposition*, Clarendon Press, Oxford (1994) and U.S. Pat. No. 4,401,609 to McGarry et al., assigned to Owens-Corning Fiberglas Corp.) and may be readily applied by the person skilled in the art to the production of the precious metal powder in the course of the process of the present invention. Conveniently, a conventional 4-jet system may be used with water pressure of from 1,000 to 7,500 psi (6.89 to 51.71 MPa), preferably 2,000 to 4,000 psi (13.79 to 27.58 MPa) and typically 2,500 psi (17.24 MPa). The flow rate and the aperture size of the nozzle(s) producing the jet(s) may be selected accordingly. Preferably, some or all of the water recovered from the atomization process is recycled for further use; however, the recycled water may be supplemented with, for example, ordinary mains water as necessary.

The powder is recovered in a tank or other collecting vessel, from which it is transferred to a metal tray, upon which it is conveyed to an oven for drying in air, typically at a temperature of about 110° C. Normally, a secondary drying step is required in order to drive off water molecules that may have remained adhering to the surfaces of the metal particles. Such secondary drying may be effected under reduced pressure, especially in a vacuum, at a temperature of about 180° C.

The dried powder is then classified, if necessary, in order to remove the larger and coarser particles (which may thereafter be recycled), thereby to improve subsequent sintering. The larger and coarser particles may be removed on a mesh, screen or sieve that retains particles having a particle size of 125 $\mu$m or greater. Preferably, the powder which is subjected to compaction has a mean particle size of from 15 to 45 $\mu$m (microns), typically about 20 $\mu$m. Preferably, from 45 to 75%, more preferably 55 to 65% and typically about 60%, by weight of the powder will pass through a standard 38 $\mu$m sieve.

The powder obtained from the classifying step may be used as such for subsequent processing. However, in commercial practice, it will normally be desirable to standardise the apparent density of the powder with a view to obtaining consistent fill in the compaction die. To this end, it may be preferred to measure the apparent density of each batch obtained from the classifying stage and to blend the batches in appropriate proportions in order to achieve a desired density.

Powder obtained by water atomization should account for at least 80%, by weight, of the powder used in the compaction step, preferably at least 90%, more preferably at least 95% and most preferably 98–100%. The remainder, if any, of the powder may be precious metal powder obtained by other methods, e.g. gas atomization, electrolysis, oxide reduction, hydrometallurgy, or grinding or other mechanical size-reduction.

For the production of rings, the powder may thereafter be compacted, using a conventional powder metallurgy compaction press and appropriate dies and punches, to form objects ("compacts") having a hollow, substantially cylindrical shape. The pressure used will generally be in the range of 10 to 100 tons per square inch (154 to 1544 MPa), preferably 25 to 70 tons/inch$^2$ (386 to 1,081 MPa), more preferably 30 to 55 tons/inch$^2$ (463 to 849 MPa) and typically about 40 tons/inch$^2$ (618 MPa). The diameter and width of the object may be adjusted, depending upon the size of the ring to be produced from it. One can also adjust the ring weight per die. Although the Applicant does not wish to be bound by any theory, it is believed that the water atomization step gives rise to particles having shapes that allow them to key or lock together effectively during compaction.

As an alternative to a compaction process using a die and a punch, the metal powder may be first compacted so as to form a tube, for example by introducing the powder between a mandrel and a flexible, e.g. latex rubber, tube in an isostatic press. The resultant metal tube may then be subjected, for example on a suitable lathe, to a series of cuts through the tube transversely to its longitudinal axis in order to produce hollow, substantially cylindrical objects. However, this alternative procedure is not, at present, preferred.

The compaction is preferably carried out as a substantially "cold-working" or "warm-working" step, i.e. at a temperature above 0° C. but not exceeding 100° C., more preferably at a temperature not exceeding 50° C. and most preferably at ambient temperature (usually from 10–30° C.).

The compacts, however produced, preferably have a ratio of wall thickness to height of from 1:0.5 to 1:3.5, more preferably from 1:1.5 to 1:3.0, and typically about 1:2 to 1:2.5.

The hollow, substantially cylindrical objects ("compacts") are then sintered, in order to cause the particles at least partially to bond together or consolidate. Preferably, the sintering is carried out at a temperature of from (0.6× solidus) to (0.99×solidus). Unless otherwise stated, in this specification the solidus (by which is meant the temperature at which a metal or alloy when heated begins to melt) is expressed in degrees Celsius. Preferably, the sintering is carried out in a reducing atmosphere, for example an atmosphere consisting essentially of 90–95% by volume of nitrogen and 5–10% by volume of hydrogen. This sintering step is preferably carried out for at least 0.25 hour, more preferably for from 0.5 to 2 hours, and typically for about 1 hour in an appropriate furnace.

The hollow, substantially cylindrical object obtained after sintering ("sintered compact") is then repressed, in particular reduced in height, as by compression. (For the avoidance of doubt, height here is the dimension that would be measured in the direction of the length of the finger on which the ring would be wom.) Preferably, the reduction in height—as measured by the formula [(HB—HA)/HB]×100%, where HB is the height before repressing and HA is the height after repressing—is at least 8%, and most preferably at least 10%. Again, although the Applicant does not wish to be bound by theory, it is believed that this repressing or squashing operation stresses the compacted and sintered material, thereby putting energy into the material which facilitates consolidation. In the production of rings this operation will generally convert the hollow, substantially cylindrical object into a substantially toroidal (or "doughnut") shape; however, the present invention is not limited to any particular cross-section for the ring products: rings produced according to the present invention may have, for exarnple, any conventional cross-sectional shape, for instance circular, elliptical or D-shaped.

The repressed objects are then subjected to a further, and usually final, sintering step, preferably for at least 8 hours, more preferably from 12 to 120 hours, and typically for about 24 hours. Preferably, this sintering is carried out at a temperature of from (0.6×solidus) to (0.99×solidus). Preferably, this sintering is carried out in a reducing atmosphere, e.g. one consisting of 90–95% by volume of nitrogen and 5–10% by volume of hydrogen. Preferably, the metal of the resultant object should exhibit a low porosity, preferably having a total content of voids of less than 8% by volume, more preferably less than 7% by volume, most preferably 0 to 6% by volume and typically only 1–5% by volume.

The resultant object may then be subjected to ring rolling, which may be carried out in a conventional manner, so as to produce semi-finished artefacts, in particular semi-finished wedding rings, which, following inspection, may then be subjected to annealing. The ring rolling is preferably carried out as a substantially "cold-working" or "warm-working" step, i.e. at a temperature above 0° C. but not exceeding 100° C., more preferably at a temperature not exceeding 50° C. and most preferably at ambient temperature (usually from 10–30° C.).

The annealing step, which is normally the final annealing step, is in general carried out in order to complete the consolidation (densification) of the metal (ring rolling having again induced stresses in the metal); annealing may also help to prevent stress corrosion in the finished artefact, especially with lower-carat gold alloys. In general, the annealing is carried out for a period of 0.25 to 10 hours, preferably from 0.33 to 4 hours. Preferably, the annealing is carried out at a temperature of (0.4×solidus) or higher, e.g. from (0.6×solidus) to (0.99×solidus). Preferably, this annealing is carried out in a reducing atmosphere, e.g. one consisting of 90–95% by volume of nitrogen and 5–10% by volume of hydrogen.

Annealing will generally soften the metal, and the extent of the softening may be determined on samples before and after annealing using a standard Vickers hardness test (as described in BS 427 or in ISO 6507/1 and 6507/2). The softening may assist the jeweller in subsequent sizing or other operations carried out on the ring or other artefact. However, in the case of watch cases and the like, the softening caused by the annealing step is desirably not substantial, since watch cases are commonly finished by machining and this is best carried out on a relatively hard material. The term "annealing" herein therefore also includes not only full annealing but also partial annealing or heating to relieve at least part of the stress induced in the body by any preceding step. The annealing step is also advantageous when the artefacts are coin or medallion blanks, since it prepares them for the final minting or coining operation.

Following annealing, the rings may be subjected to conventional finishing operations, such as polishing, diamond cutting and/or engraving.

The embodiments described above may be modified. Thus, certain preferred embodiments of the present invention involve sintering in one or more steps, the total time for the sintering being at least 8 hours, preferably at least 12 hours, more preferably at least 18 hours. It has been found also that where the first sintering step, i.e. the sintering of the compacts, is carried out for a sufficient period of time, the second sintering step can be omitted. In this case, the compacts are preferably sintered for at least 8 hours, more preferably from 12 to 120 hours, and typically for about 24 hours. Preferably such sintering is carried out at a temperature of from (0.6×solidus) to (0.99×solidus). Preferably, this sintering is carried out in a reducing atmosphere, e.g. one consisting of 90–95% by volume of nitrogen and 5–10% by volume of hydrogen.

It may also be possible to carry out sintering and/or annealing under another atmosphere than a reducing atmosphere. Thus, the sintering and/or annealing of platinum or a platinum alloy in air may come into consideration.

Where the compaction has been carried out with sufficient precision, and especially when the compact has been sintered for a prolonged period, as described above, it may be possible to dispense with the step of modifying the shape and/or dimensions of the body (such as the repressing step). Thus, in the production of rings, it may be possible to subject the compacted body to a prolonged sintering step, the sintered compacts being either subjected to ring rolling, or subjected to repressing or the like, the resultant bodies then being subjected to ring rolling.

The process of the present invention can give rise to a number of significant advantages over the conventional process described above. Thus, it has been found possible to obtain a better yield of product, typically at least 85%, and possibly as high as 90–95% by weight of the initial melt. Furthermore, the process is less time-consuming and more economical to operate, and lead times are significantly reduced. Thus, it has been found possible to produce the semi-finished rings within a period of about five days by the present process, compared with a period of ten days that is typically required when using the conventional, Karl Klink process. Labour costs may also be reduced.

In the finished product, it has been found that the mean grain size is generally less than 0.025 mm, and is typically 0.005–0.010 mm: this comparatively small grain size diminishes the so-called "orange peel effect", which can mar the appearance of rings and the like produced by conventional processes. The metal in the finished products obtained according to the present invention has been found to be comparable or greater in ductility as against the metal in rings made by the Karl Klink process, which gives rise to the possibility that a ring produced according to the present invention may be adjusted in diameter over a greater number of finger sizes. Furthermore, rings obtained according to the present invention have been found to be harder than those obtained according to the Karl Klink process: as will be appreciated, this will render the ring more resistant to scratching, harder wearing, and likely to retain the sharpness of engraved or machined patterns for a longer period of time. It is to be expected, therefore, that returns by customers of damaged rings would be significantly reduced by the application of the present process.

By way of illustration, there has been described above a process according to the present invention for the production of wedding rings from 9 carat gold alloy. It will be appreciated, however, that the process of this invention may be utilised for the production of artefacts other than wedding rings, for example other types of ring, medallions, watch cases and like items of jewellery, as well as ingots and coins. For example, watch cases may be manufactured by compacting the powder into a circular hollow blank, which is thereafter sintered. The sintered body may subsequently be subjected to forging (e.g. using punches of the required profile) and thereafter heated at least partially to relieve stress (which heating step is within the expression "annealing" as understood herein). The resultant body may be finished by machining and/or polishing and/or the like. In embodiments which are directed to the production of artefacts other than rings or ring-like objects, it is preferred that the body obtained by compaction—which body may be in the form of a solid plate, for example a solid disc should have a ratio of long dimension (the diameter in the case of discs) to height of from 1:3.5 to 40:1, more preferably 1:2 to 30:1. Of course, where the artefact to be produced is other than a ring or ring-like object, the ring-rolling step described above will be inapplicable. In such cases, therefore, the ring-rolling step may be replaced by another appropriate step of modifying the shape and/or dimensions of the body obtained after sintering of the compact, after repressing or after a second sintering step, or such a step may be omitted entirely, whereby the body obtained will, for instance, simply be repressed and sintered, or a step of modifyig the shape may be used after the initial sintering step.

Furthermore, the invention is not limited to the use of 9 carat gold alloy (37.5% gold): indeed, one may use any grade of gold alloy, in particular a gold alloy having a value of 8 carats or higher. The content of gold in a gold alloy, for instance for jewellery, is preferably from 30% to 95% by weight: this encompasses the usual carat values of from 8 carats (33.3% gold) to 22 carats (91.6% gold), although higher contents of gold or even pure (100%) or substantially pure gold are not precluded. Furthermore, although yellow gold alloy is normally used, white or red gold alloy, for example, may also come into consideration. Moreover, the process may utilise precious metals other than gold, for example silver, platinum, alloys of platinum, especially alloys containing 80% or more of platinum, palladium and alloys of palladium. Alloys of, or containing, two or more precious metals may also come into consideration.

The invention is now further illustrated by reference to the following Examples:

EXAMPLE 1

Manufacture of 9 ct Yellow Gold "D" Section Wedding Rings, Each Weighing 6.4 Grams Zinc, copper, silver and gold were loaded into a clay graphite crucible in an induction melting furnace to a total weight of 10 kg, in the foregoing order and in the following proportions: Au 37.52%, Ag 10.4%, Cu 44.08% and Zn 8% by weight. Pieces of charcoal and a hydrogen flame were then applied to the starting materials to prevent oxidation, and the mixture was heated to 1060° C. by raising the temperature in the furnace. 1 g of lithium de-oxidant was added to the melt, once it had reached the required temperature The melt temperature was then increased to 1070° C., and the metal was poured into a tundish having a 4.7 mm diameter nozzle. The tundish had previously been heated to 1100° C. and a hydrogen cover had then been applied. Water at 1725 MPa was supplied to atomizer jets below the tundish nozzle, and the stream emerging from the tundish was atomized into powder and collected in a tank. The powder was allowed to settle for 1 hour before removal of water. The powder was then dried overnight at 110° C., before being heated for a further 4 hours at 180° C. in an oven evacuated to 200 Pa.

Powder particles coarser than 125 $\mu$m were removed by sieving, and the powder was blended to improve homogeneity. (If necessary, 9 ct yellow gold powder of appropriate apparent density can then be added at this stage to adjust the apparent density to fall within the range 4.17 to 4.23 g.cm$^3$.)

The powder was then compacted in a compaction press operating at 618 MPa to produce cylindrical compacts having an outside diameter of 14.5 mm, an inside diameter of 9 mm, a weight of 6.4 g and a nominal height of 6.7 mm. The resulting compacts were sintered for 1 hour at 780° C. in an atmosphere of 95% nitrogen/5% hydrogen. The compacts were then repressed to a height of 6.1 mm, followed by sintering for a further 24 hours at 780° C. in the same nitrogen/hydrogen atmosphere.

Weddings rings of the required finger sizes were then produced from the compacts by a conventional ring rolling operation, and the semi-finished rings were annealed for 0.5 h at 780° C. in the nitrogen/hydrogen atmosphere.

EXAMPLE 2

Manufacture of 18 ct "Court" Style Ladies' Wedding Rings Each Weighing 5.1 Grams Copper, silver and gold were loaded into a crucible as described in Example 1, to a total weight of 10 kg, and in the following proportions: Au 75.1%, Ag 13.9% and Cu 11.0% by weight. The procedure described in Example 1 was then followed to produce an 18 ct gold powder, except that the melt was raised to 1070° C. prior to addition of the lithium de-oxidant, and it was then raised to 1080° C. for pouring.

The apparent density of the powder was adjusted to 5.85–5.90 g.cm$^{-3}$, if necessary, by the addition of 18 ct yellow gold powder of the appropriate apparent density, and the powder was then compacted as described in Example 1 to form cylindrical compacts having an outside diameter of 14.0 mm, an inside diameter of 9 mm, a nominal height of 5.9 mm and a weight of 5.1 g.

The compacts were sintered for 1 hour at 870° C. in an atmosphere of 95% nitrogen/5% hydrogen, and they were then repressed to a height of 5.1 mm, followed by sintering for a further 24 hours at 870° C. in the same nitrogen/hydrogen atmosphere.

Weddings rings of the required finger sizes were then produced from the compacts by a conventional ring rolling operation, and the semi-finished rings were annealed for 0.5 h at 870° C. in the nitrogen/hydrogen atmosphere.

EXAMPLE 3

Manufacture of 9 ct yellow gold "D" Section Wedding Rings Each Weighing 6.4 Grams.

The procedure described in Example 1 was followed up to the compaction of the powder. In the present example, the powder was compacted in the compaction press operating at 772 MPa to produce cylindrical compacts having an outside diameter of 14.5 mm, an inside diameter of 9 mm, a weight of 6.4 g and a nominal height of 6.4 mm. The resultants compacts were sintered for 24 hours at 780° C. in an atmosphere of 95% nitrogen/5% hydrogen; this was found to cause the compacts to shrink to a height of about 6.0 mm. Weddings rings of the required finger sizes were thereafter produced from the resultant compacts by a conventional ring-rolling operation, and the semi-finished rings were annealed for 0.5 h at 780° C. in a 95% nitrogen/5% hydrogen atmosphere.

It will of course be understood that the present invention has been described above purely by way of example and that modifications of detail can be made within the scope of the invention.

What is claimed is:

1. A process for the manufacture of an artifact from a precious metal, which process comprises compacting a precious metal powder into a shaped body, wherein at least 80% by weight of the powder has been produced by water atomization of a stream of molten precious metal; sintering the said body; thereafter modifying the shape and/or dimensions of the body by a step selected from repressing, forging, and ring-rolling, and thereafter annealing the said body.

2. A process according to claim 1, in which the stream of molten metal is a stream falling from an orifice under gravity.

3. A process according to claim 1, in which the atomizing is effected by impinging at least one jet of water onto the stream of molten metal.

4. A process according to any of claim 1, in which the metal powder is dried before it is compacted.

5. A process according to claim 1, directed to the production of a ring, in which the modifying of the shape and/or dimensions of the body comprises a ring-rolling step.

6. A process according to claim 5, which comprises, between the said sintering step and the ring-rolling step, the further step of repressing the body.

7. A process according to claim 6, in which the repressing step is effected by pressing the body and thereby reducing its height or by compacting, compressing or squashing the body.

8. A process according to claim 6, which comprises, between the said repressing step and the said ring-rolling, the further step of sintering the body.

9. A process according to claim 8, in which the sintering of the shaped body is effected for from 0.25 hour to 2 hours and the step of further sintering is effected for 8 to 120 hours.

10. A process according to any of claim 1, directed to the production of a ring, which comprises compacting the metal powder to form a body of hollow, substantially cylindrical shape, sintering the shaped body, optionally compressing the sintered body in order to reduce its height, rolling the resultant sintered body into a ring, and subjecting the ring to annealing.

11. A process according to claim 10, in which the sintering of the shaped body is effected for from 8 to 120 hours.

12. A process according to claim 9 in which the shaped body is formed by compacting the powder in a die.

13. A process according to claim 9 in which the shaped body is formed by compacting the powder into the form of a tube and subdividing the tube to form a plurality of hollow, substantially cylindrical bodies.

14. A process according to claim 10 in which the shaped body shrinks in height during said sintering.

15. a process according to claim 1, in which the precious metal is gold, an alloy containing gold, silver, an alloy containing silver, platinum, an alloy containing platinum, palladium or an alloy containing palladium.

16. A process according to claim 15, in which the precious metal is an alloy comprising 30% by weight to 92% by weight of gold, or is platinum, or is an alloy containing at least 80% by weight of platinum.

17. A process according to any of claim 1, in which the metal forming the artefact has a porosity of less than 8% by volume.

18. A process according to any of claim 1, in which the metal forming the artefact has a content of oxide (measured as oxygen) of no more than 0.01% by weight of the metal.

19. An artefact whenever manufactured by a process according to any of claim 1.

20. A process according to any preceding claim in which the artefact is a wedding ring.

21. A process according to claim 1, in which the body obtained by the compaction of the powder is sintered and thereafter subjected to forging.

22. A process according to claim 21, in which the forging is effected using a punch of the required profile.

23. A process according to claim 1, in which the body obtained by compaction of the powder is sintered and thereafter subjected to repressing.

24. A process for the production of a ring from a precious metal, which comprises the steps of producing a powder from molten precious metal by water atomisation; drying the powder under reduced pressure; compacting the precious metal powder, from which particles coarser than 125 $\mu$m have been removed, to form a body of hollow, substantially cylindrical shape; sintering the body under a reducing atmosphere; rolling the body to form a ring; and subjecting the ring to annealing.

25. A process according to claim 24 in which, prior to the rolling step, the sintered body is compressed to reduce its height.

26. A process according to claim 25 in which after the sintered body has been compressed to reduce its height and before the rolling step, the body is further sintered under a reducing atmosphere.

27. A process for the manufacture of an artefact from a precious metal, which process comprises producing at least 80% by weight of the precious metal powder by water atomization of a stream of molten precious metal; compacting the powder into a shaped body, and sintering the said body; thereafter modifying the shape and/or dimensions of the body by a step selected from repressing, forging or ring-rolling and thereafter annealing the said body.

* * * * *